US006503340B1

(12) United States Patent
Gold et al.

(10) Patent No.: US 6,503,340 B1
(45) Date of Patent: Jan. 7, 2003

(54) METHOD FOR PRODUCING CHROMIUM CARBIDE COATINGS

(75) Inventors: Michael Gold, Deerfield Township, Portage County, OH (US); Douglas D. Zeigler, Marlboro Township, Stark County, OH (US); George H. Harth, III, Wadsworth, OH (US); James M. Tanzosh, Silver Lake, OH (US); Dale LaCount, Alliance, OH (US); Steven C. Kung, Plain Township, Stark County, OH (US); Walter R. Mohn, Plain Township, Stark County, OH (US)

(73) Assignees: The Babcock & Wilcox Company, New Orleans, LA (US); McDermott Technology, Inc., New Orleans, LA (US)

( * ) Notice: Subject to any disclaimer, the term of this patent is extended or adjusted under 35 U.S.C. 154(b) by 0 days.

(21) Appl. No.: 09/631,207

(22) Filed: Aug. 2, 2000

(51) Int. Cl.[7] ..... C23C 10/10; C23C 10/32; C23C 10/38

(52) U.S. Cl. ..... 148/217; 148/264; 148/278

(58) Field of Search ..... 148/217, 220, 148/225, 239, 264, 278

(56) References Cited

U.S. PATENT DOCUMENTS 4,012,238 A * 3/1977 Scales ..... 148/217
4,711,676 A * 12/1987 Kitaori et al. ..... 148/319
4,869,936 A 9/1989 Moskowitz et al.
5,135,777 A 8/1992 Davis et al.
5,194,219 A * 3/1993 Baldi ..... 419/37
5,873,951 A * 2/1999 Wynns et al. ..... 148/242
5,912,050 A 6/1999 Zeigler et al.
5,972,429 A 10/1999 Bayer et al.

FOREIGN PATENT DOCUMENTS

JP 56-041369 A * 4/1981 ..... C23C/9/02
JP 56-041370 A * 4/1981 ..... C23C/9/02
JP 56-112460 A * 9/1981 ..... C23C/9/02
JP 57-085967 A * 5/1982 ..... C23C/9/02
JP 57-134551 A * 8/1982 ..... C23C/9/02

OTHER PUBLICATIONS

ASM International Handbook Committee, *ASM Handbook*, pp 497–509, vol. 5, ASM International, Materials Park, OH, USA. No year data.

* cited by examiner

*Primary Examiner*—Roy King
*Assistant Examiner*—Harry D. Wilkins, III
(74) *Attorney, Agent, or Firm*—R. C. Baraona

(57) ABSTRACT

A method for producing chromium carbide coatings on steel provides a steel component having a surface which is carburized to contain at least about 0.40% by weight carbon and is followed by chromizing the surface to form a chromium carbide coating on the surface.

29 Claims, No Drawings

METHOD FOR PRODUCING CHROMIUM CARBIDE COATINGS

FIELD AND BACKGROUND OF THE INVENTION

The present invention relates in general to coating methods for metals and, in particular, to a new and useful method for chromizing ferrous-base and/or nickel-base metal parts and components for improving their erosion and high temperature corrosion resistance.

A number of processes to produce wear-resistant or corrosion-resistant surface diffusion coatings have been developed, patented, and commercialized for use in low, intermediate, and high temperature industrial applications where steel parts are subjected to significant levels of erosion and various levels of oxidation and sulfidation corrosion. Examples of these coating processes include chromizing (diffusion of chromium into the surfaces of steel components) and carburizing (diffusion of carbon into the surfaces of steel components).

Chromized coatings provide excellent protection against high temperature corrosion, especially in applications where combustion is involved, such as in boilers. Case carburizing produces hard, durable surfaces which provide protection against erosive wear, especially in applications where abrasives, such as coal, ore, or silicates, are processed.

In many industrial operations, components need to be protected from both erosion and elevated temperature corrosion. A type of coating that provides protection against hot erosive wear and corrosion is a continuous layer of chromium carbide. Although very thin chromium carbide surface layers (typically 1 mil thick or less) may be incidentally produced in the process of chromizing, such thin layers are not sufficiently durable to provide effective, long-term resistance against hot erosive wear in utility boilers. Moreover, both incidental and intentional chromium carbide layers created by current methods are often non-uniform and do not have a consistent, continuous character (instead, these layers typically have a particle-base characteristic).

It is known from the technical literature that the composition of a protective chromium carbide layer will be of the general form $M_{23}C_6$. Additionally, it is known that chromium carbides produced in the surfaces of carbon steels have a more complex form, $(Cr, Fe)_{23}C_6$. Under certain thermal processing conditions, the presence of certain carbide stabilizers in the alloy composition, such as titanium, columbium, or zirconium, may further alter the protective layer so that the layer partially consists of other carbide forms, including $M_3C$ and $M_7C_3$. Thus, the alloy composition and thermal processing conditions for a component which is to be coated with chromium carbide can have a significant effect on the form, structure, composition, and overall quality of any resulting chromium carbide coating. Notably and as above, most currently known chromium carbide layers are not continuous and, instead, are composed of individual carbide particles.

U.S. Pat. No. 5,912,050, assigned to McDermott Technology, Inc. and The Babcock & Wilcox Company, discloses an improved method for chromizing small parts in a retort. U.S. Pat. No. 5,135,777, assigned to The Babcock & Wilcox Company, discloses a method for diffusion coating a workpiece with various metals including chromium by placing ceramic fibers next to the workpiece and then heating to diffuse the diffusion coating into the workpiece. U.S. Pat. No. 5,344,502, assigned to The Babcock & Wilcox Company, discloses a method for pack carburizing certain stainless steels. All of these patents are hereby incorporated within.

SUMMARY OF THE INVENTION

The present invention produces chromium carbide coatings, greater than 5 mils thick, in the metal surface of a component and contemplates two basic methods for producing a protective chromium carbide coating in the surface through diffusion at elevated temperatures: (a) pack carburizing ferrous-base and/or nickel-base metal surfaces, followed by chromizing; and (b) chromizing metal surfaces containing higher levels of carbon (≧0.40%C). Use of the term "chromizing" expressly includes co-diffusion methods known in the art. These methods successfully produce robust chromium carbide coatings (a coating with a thickness greater than 5 mils) in many steels, including T11, T22, 309 stainless steel, 310 stainless steel, 316 stainless steel, AISI 4140, AISI 4340 and UNS N06600 (a nickel-base alloy also known as Inconel 600™). Accordingly, the invention provides a feasible and commercially viable method for producing chromium carbide coatings in metal surfaces, including ferrous materials, such as carbon steels, and nickel-base alloys, such as Inconel 600™.

Testing of the present invention showed the unexpected importance of the processing sequence; i.e., the necessity of having the carbon in the substrate material before chromizing, in order to form the chromium carbide coating. Specifically, it was found that chromizing the material first, followed by carburizing, would not form a useful or substantial chromium carbide coating. It is believed that the mobility and inward diffusion of carbon atoms is somehow reduced or restricted when chromium atoms are already present at some threshold concentration within the matrix, while the diffusion of chromium atoms within a matrix containing significant concentrations of carbon atoms is apparently not restricted.

The present invention comprises a method for producing chromium carbide coatings by providing a component having a metal surface, made of a ferrous-base and/or nickel-base material which includes a selected amount of carbon (i.e., alloyed or carburized to contain at least 0.40% by weight carbon) and then chromizing the surface to form a chromium carbide coating on the surface.

Another aspect of the invention further includes a method wherein the metal surface of the component is carburized, by any known carburizing method, prior to the chromizing step.

Yet another aspect of the invention further includes the application of tailored laminate coatings subsequent to the chromizing step so as to impart upon the resulting steel component a multi-layered coating with specific, desired qualities.

Accordingly, an object of the present invention is to provide a method for producing components with surfaces having a robust chromium carbide coating. Such a coating will enhance the wear and corrosion resistance of the resulting component. Furthermore, this coating is continuous and may further consist of multiple discrete layers, with each layer having its own particular morphology and concentration of chromium carbide precipitates. The continuous nature and, where applicable, layered structure of the coatings provided by the present invention further enhance its performance and durability in comparison to previous chromizing and/or carburizing methods.

Another object of the invention is to provide a method for producing components with surfaces having a tailored, multi-layered coating(s), including a base chromium carbide coating, in order to increase the resulting components' wear and corrosion resistance (in addition to any further properties inherent to the tailored coating(s) that may be selected). The tailored, multi-layered coating includes a chromium carbide layer diffused into the surface and subsequent application of at least one additional layer selected from: titanium nitride, zirconium nitride, tantalum nitride, chromium nitride, and cobalt-tungsten carbide. This tailored coating is not necessarily diffused, but instead may reside on top of the original chromium carbide coating.

The method of applying the additional tailored layer(s) is selected according to the composition of each layer and includes: thermal spraying, physical and/or chemical vapor deposition, and sputter-ion plating. Those skilled in the art will appreciate the significance of using these specific layers, either singly or in combination, and further will understand the methods necessary to apply each additional layer(s).

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which a preferred embodiment of the invention is illustrated.

DESCRIPTION OF THE PREFERRED EMBODIMENT

The ability to easily produce robust, continuous chromium carbide coatings, wherein coatings potentially have multiple, discrete, continuous layers with individual morphologies and/or concentrations of chromium carbide precipitates, is one of the unique features of this invention. These coatings may be applied to ferrous-base and/or nickel-base metal surfaces, such as steel and certain nickel-base alloys. Thus, this invention can be utilized to protect critical components in utility boilers from both erosion and high temperature corrosion. Such technology provides a competitive edge in providing more durable replacement parts for the power generation, energy equipment and service industries. By way of example and not limitation, the chromium carbide coating technology of the present invention is also expected to be useful in the automotive, aerospace and marine construction industries.

As an extension of the basic concept of this invention, it is envisioned that additional layers of other corrosion-resistant and wear-resistant materials might be applied in conjunction with a protective chromium carbide diffusion layer to produce an array of tailored composite protective coating systems. An example of a tailored laminate composite coating might involve the physical vapor deposition of titanium nitride on the chromium carbide surface layer. Other layers of zirconium nitride, tantalum nitride, chromium nitride and the like, could also be deposited on the chromium carbide coating by different processes, including chemical vapor deposition, sputter ion plating and the like. Further overlay coatings, such as cobalt-tungsten carbide and the like, can be thermally sprayed on the chromium carbide layer to provide additional protection. Both a singular chromium carbide coating, as well as a tailored multi-laminate composite coating applied on top of an initial chromium carbide diffusion layer, would be useful for protecting high temperature steel parts and for increasing the service lives of high temperature components such as boiler waterwall panels, burners, industrial furnaces, automotive exhaust systems and the like.

In any of the embodiments of the invention, the workpiece must initially contain a requisite amount of carbon in order to impart a useful chromium carbide coating. Specifically, the original workpiece must be a ferrous-base or nickel-base metal surface on a component, and the surface must be alloyed or carburized to have a carbon content of at least 0.40%. Alternatively, prior to the chromizing step, the workpiece may be carburized using any known carburizing method, including those discussed below. Notably, while the term "chromium carbide coating" is used throughout this specification, it will be understood by those skilled in the art that this chromium carbide coating is actually diffused into the metal surface to a specific depth (for example, some methods according to the present invention will impart a coating in the surface that is at least 5 mils thick, as measured from the exposed, outermost part of the surface of the component).

Carburizing is the addition of carbon to a surface at selected temperatures which permits formation of a high-carbon surface layer superimposed into the surface. Carburizing methods include gas carburizing, vacuum carburizing, plasma carburizing, salt bath carburizing, and pack carburizing.

Pack carburizing is a process in which carbon monoxide derived from a solid compound decomposes at the metal surface into nascent carbon and carbon dioxide. The nascent carbon is absorbed into the metal, and the carbon dioxide immediately reacts with carbonaceous material present in the solid carburizing compound to produce fresh carbon monoxide. The formation of carbon monoxide is enhanced by energizers or catalysts, such as barium carbonate ($BaCO_3$), calcium carbonate ($CaCO_3$) and sodium carbonate ($Na_2CO_3$), that are present in the carburizing compound. These energizers facilitate the reduction of carbon dioxide with carbon to form carbon monoxide. Thus, in a closed system, the amount of energizer does not change.

Carburizing continues as long as enough carbon is present to react with the excess carbon dioxide.

Common commercial carburizing compounds are reusable and contain 10 to 20% alkali or alkaline earth metal carbonates bound to hardwood charcoal or to coke by oil, tar or molasses.

Barium carbonate is the principal energizer, usually comprising about 50 to 70% of the total carbonate content. The remainder of the energizer usually is made up of calcium carbonate although sodium carbonate also my be used.

Carburizing can be achieved in accordance with the present invention using the combination of chemicals, listed in Table 1, used in the carburizing box at elevated temperatures with the workpiece. However, it is understood that the information in Table 1 is merely illustrative and that those skilled in the art may practice the present invention using any known carburizing compounds.

TABLE 1

| INGREDIENT | % BY WEIGHT |
|---|---|
| Charcoal | 85% |
| Barium Carbonate ($BaCO_3$)[a] | 10% |
| Calcium Carbonate ($CaCO_3$)[b,c] | 5% |

[a]This compound is a major ingredient in rodent poisons and must be handled with great caution.
[b]This compound can be found in chalk, limestone and marble.
[c]This compound may be replaced with Sodium Carbonate ($Na_2CO_3$) in an appropriate amount.

Pack carburization may be optimally performed at a temperature between 1,500° F. to 1,750° F. However, depending on the metal, some carburization takes place at temperatures as high as 2,000° F. Moreover, as a general rule, the rate of carburization at the given temperature appears to be proportional to the square root of time in hours. It was noted that this rate of carburization appeared to be greatest at the beginning of the cycle and then diminished with time.

Generally, for a heavy case thickness (~0.075 inches), 12 hours of heating at optimal temperature was sufficient to carburize the workpiece for the purposes of the present invention; for a light case (~0.020 inches), 3 hours was sufficient. Mean temperatures during either of these periods was about 1,700° F.

Turning to specific examples, carburizing for 12 hours at 1,700° F. followed by chromizing (as discussed below) succeeded in forming chromium carbide coatings on T22 steel, 309 stainless steel, 310 stainless steel, 316 stainless steel and Inconel $_{600}$™ (a nickel-base alloy also known as UNS N06600). The formation of chromium carbide in steels, such as AISI 4140 and AISI 4340 steel, was also improved when the steel was initially pack carburized (prior to chromizing); but, it must be noted that the carbon content of these steels was initially sufficient such that chromizing without pack carburization also achieved the minimum of 5 mils chromium carbide coating without difficulty. Finally, it was discovered that to achieve a desired coating in a workpiece with case depth of 0.250 inches (such as T11 steel), heating for several days at elevated temperature was required. Based upon these results, it is believed that this technique is applicable to any ferrous-base material and to at least certain nickel-base materials, such as Inconel 600™.

Subsequent to the carburization (or, if a workpiece of appropriate carbon content is pre-selected, after selection of the workpiece), the workpiece must be chromized in order to impart the desired chromium carbide coating. Significantly, the sequence of the present invention (achieving the carbon level first, followed by chromizing) is of the utmost importance. More plainly stated, the inventors have discovered, contrary to their expectations, that carbon must initially be present in the workpiece prior to the chromizing in order to form a usefill, robust chromium carbide coating. If the carbon is not present, it appears that the mobility and inward diffusion of carbon through a previously chromized layer is insufficient to form a robust chromium carbide coating.

After the initial chromium carbide layer is formed, further tailored laminate layers may be applied over the chromium carbide layer in order to further enhance the desired characteristics of the workpiece. Notably, the addition of these tailored laminate layers, as well as any overlay layers applied on top of the first tailored laminate layer, do not appear to negatively impact or influence the function or performance of the chromium carbide layer. Examples of additional tailored laminate layers include: titanium nitride, zirconium nitride, tantalum nitride, chromium nitride, and cobalt-tungsten carbide. The method of applying these additional overlay layers may be selected according to the composition of each layer and include: thermal spraying, physical and/or chemical vapor deposition, and sputter-ion plating. Those skilled in the art will appreciate the significance of using these specific layers, either singly or in combination, and will also understand the methods necessary to apply each additional layer(s).

The present invention also contemplates the co-diffusion of chromium with trace amounts (less than 5%) of other metals, such as silicon, boron, and the like. Notably, this co-diffusion of minor amounts of other metals will take the place of the chromizing steps and processes mentioned above. For exemplary techniques for co-diffusion, refer to U.S. Pat. No. 5,972,429. Further, U.S. patent application Ser. No. 09/415,980, filed on Oct. 12, 1999, and entitled "Method for Increasing Fracture Toughness in Aluminum-Based Diffusion A Coatings," provides a technique for chromizing via thermal spraying and discloses a co-diffusion technique for diffusing chromium with trace amounts of other elements (such as boron, aluminum, and silicon) to further enhance the properties of the resulting coating. For exemplary techniques concerning thermal spraying, refer to U.S. Pat. No. 5,873,951. Both of the patents (U.S. Patent No. 5,873,951 and U.S. Pat. No. 5,972,429) and the patent application (U.S. Pat. Ser. No. 09/415,980 filed on Oct. 12, 1999) now U.S. Pat. No. 6,302,975 mentioned above are incorporated here by reference.

For exemplary techniques to chromize steel, see the above-identified U.S. Pat. No. 5,135,777 (a coated alumino-silicate fiber method) and U.S. Pat. No. 5,912,050 (a slurry-based method), which are both incorporated here by reference.

Finally, for further information concerning physical vapor deposition, chemical vapor deposition, and sputter-ion plating techniques, refer to *Metals Handbook*, 10$^{th}$ Edition, 1990, Volume 1 ("Properties and Selection: Irons, Steels, and High-Performance Alloys") and Volume ("Surface Engineering of Irons and Steels"); *Metals Handbook Desk Edition*, 1985; and/or *ASM Handbook*, 1994, Volume 5 ("Surface Engineering").

While a specific embodiment of the invention has been shown and described in detail to illustrate the application of the principles of the invention, it will be understood that the invention may be embodied otherwise without departing from such principles.

We claim:

1. A method for producing chromium carbide coatings on a metal surface comprising:

providing a component having a surface, the surface containing at least a selected amount of carbon and wherein the surface is a nickel-base alloy; and chromizing the component to form a continuous chromium carbide coating on the surface.

2. A method according to claim 1, wherein the selected amount of carbon is at least 0.40% by weight.

3. A method according to claim 1, wherein the nickel-base alloy is UNS N06600.

4. A method according to claim 1, wherein the chromizing step comprises a chromium diffusion coating process.

5. A method according to claim 4, wherein the chromium diffusion coating process is selected from the group consisting of: thermal spraying method, a coated alumino-silicate fiber method, a pack cementation method, and a slurry-based method.

6. A method according to claim 1, wherein the chromium carbide coating is at least 5 mils thick.

7. A method according to claim 1, further comprising a step of applying a tailored laminate coating to the nickel-base alloy surface subsequent to the chromizing step.

8. A method according to claim 7, wherein applying the tailored laminate coating step is at least one selected from the group consisting of: thermal spray deposition, physical vapor deposition, chemical vapor deposition, and sputter-ion plating.

9. A method according to claim 8, wherein the step of applying the tailored laminate coating is subsequently performed a selected number of times so as to create additional overlay coatings.

10. A method according to claim 7, wherein the step of applying the tailored laminate coating is subsequently performed a selected number of times so as to create additional overlay coatings.

11. A method according to claim 7, wherein the tailored laminate coating is at least one selected from the group consisting of: titanium nitride, zirconium nitride, tantalum nitride, chromium nitride, and cobalt-tungsten carbide.

12. A method according to claim 11, wherein the step of applying the tailored laminate coating is subsequently performed a selected number of times so as to create additional Js overlay coatings.

13. A method according to claim 1, wherein the step of chromizing comprises co-diffusion of chromium and trace amounts of other metals.

14. A method for producing chromium carbide coatings on a metal surface comprising:

providing a component having a surface, and wherein the surface is a nickel-base alloy;

carburizing the component to provide a selected amount of carbon in the surface; and chromizing the component, subsequent to the carburizing step, to form a continuous chromium carbide coating on the surface.

15. A method according to claim 14, wherein the nickel-base alloy is UNS N06600.

16. A method according to claim 14, wherein the chromizing step comprises a chromium diffusion coating process.

17. A method according to claim 16, wherein the chromium diffusion coating process is selected from the group consisting of: thermal spraying method, a coated aluminosilicate fiber method, a pack cementation method, and a slurry-based method.

18. A method according to claim 14, wherein the carburizing step comprises exposing the nickel-base alloy component at a selected temperature to a carburizing mixture for a selected period of time.

19. A method according to claim 18, wherein the carburizing mixture comprises charcoal, barium carbonate, and one of either calcium carbonate or sodium carbonate.

20. A method according to claim 18, wherein the selected temperature is between 1,500° F. to 2,000° F.

21. A method according to claim 14, wherein the carburizing step is at least one selected from the group consisting of: a gas carburizing method, a vacuum carburizing method, a plasma carburizing method, a salt bath carburzing method, and a pack carburizing method.

22. A method according to claim 14, further comprising a step of applying a tailored laminate coating to the steel surface subsequent to the chromizing step.

23. A method according to claim 22, wherein applying the tailored laminate coating step is at least one selected from the group consisting of: thermal spray deposition, physical vapor deposition, chemical vapor deposition, and sputter-ion plating.

24. A method according to claims 23, wherein the step of applying the tailored laminate coating is subsequently performed a selected number of times so as to create additional overlay coatings.

25. A method according to claim 22, wherein the tailored laminate coating is at least one selected of from the group: titanium nitride, zirconium nitride, tantalum nitride, chromium nitride, and cobalt-tungsten carbide.

26. A method according to claim 25, wherein the step of applying the tailored laminate coating is subsequently performed a selected number of times so as to create additional overlay coatings.

27. A method according to claim 22, wherein the step of applying the tailored laminate coating is subsequently performed a selected number of times so as to create additional overlay coatings.

28. A method according to claim 14, wherein the chromium carbide coating is at least 5 mils thick.

29. A method according to claim 14, wherein the step of chromizing comprises co-diffusion of chromium and trace amounts of other metals.

* * * * *